US008237650B2

(12) United States Patent
Lin et al.

(10) Patent No.: US 8,237,650 B2
(45) Date of Patent: Aug. 7, 2012

(54) DOUBLE-GATE LIQUID CRYSTAL DISPLAY DEVICE

(75) Inventors: Chin-Hao Lin, Kaohsiung (TW); Chia-Yi Lu, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 486 days.

(21) Appl. No.: 12/643,955

(22) Filed: Dec. 21, 2009

(65) Prior Publication Data

US 2011/0102414 A1 May 5, 2011

(30) Foreign Application Priority Data

Nov. 4, 2009 (TW) ..... 98137407 A

(51) Int. Cl.
*G09G 3/36* (2006.01)

(52) U.S. Cl. ..... 345/99; 345/213

(58) Field of Classification Search ..... 345/99, 345/213

See application file for complete search history.

(56) References Cited

U.S. PATENT DOCUMENTS

2011/0169797 A1* 7/2011 Song et al. ..... 345/209

* cited by examiner

*Primary Examiner* — Latanya Bibbins

(74) *Attorney, Agent, or Firm* — Winston Hsu; Scott Margo

(57) ABSTRACT

A liquid crystal display includes a first gate line, a second gate line, a data line, a first pixel unit, a second pixel unit, a gate driver, and a source driver. The first and second gate lines respectively transmit a first and a second gate driving signals provided by the gate driver, while the data line transmits a first and a second data. The first pixel unit displays images according to the first gate driving signal and the first data, while the second pixel unit displays images according to the second gate driving signal and the second data. The source driver includes a logic circuit and a multiplexer circuit. The logic circuit generates an odd/even select signal according to a scan sequence signal and an enable signal. The multiplexer circuit outputs one of the first and second data according to the odd/even select signal.

6 Claims, 8 Drawing Sheets

| UPDN | ODD_EN | O/E_S | Operation of multiplexer circuit |
|---|---|---|---|
| 0 | 0 | 0 | Output even-numbered data |
| 0 | 1 | 1 | Output odd-numbered data |
| 1 | 0 | 1 | Output odd-numbered data |
| 1 | 1 | 0 | Output even-numbered data |

FIG. 6

DOUBLE-GATE LIQUID CRYSTAL DISPLAY DEVICE

BACKGROUND OF THE INVENTION

1. Field of the Invention

The present invention is related to a liquid crystal display device, and more particularly, to a double-gate liquid crystal display device.

2. Description of the Prior Art

Liquid crystal display (LCD) devices, characterized in low radiation, small size and low power consumption, have gradually replaced traditional cathode ray tube (CRT) displays and been widely used in various electronic products, such as notebook computers, personal digital assistants (PDAs), flat panel TVs, or mobile phones. An LCD device display images by driving the pixels of the panel using source drivers and gate drivers. According to the driving modes, an LCD device may adopt a single-gate pixel structure or a double-gate pixel structure. The LCD device with double-gate pixel structure includes twice the number of gate lines and half the number of data lines, and thus requires more gate driving chips and fewer source driving chips when compared to the LCD device with single-gate pixel structure for the same resolution. Compared to a source driving chip, a gate driving chip is less expensive and consumes less power. Therefore, double-gate pixel structure can reduce manufacturing costs and power consumption.

FIGS. 1 and 2 are diagrams illustrating prior art double-gate LCD devices 100 and 200. The LCD devices 100 and 200 both include a timing controller 130, a source driver 110, a gate driver 120, a plurality of data lines $DL_1$-$DL_m$, and a plurality of gate lines $GL_1$-$GL_n$. The timing controller 130 can generate control signals for operating the source driver 110, such as a horizontal synchronization signal HSYNC, a horizontal start pulse signal STH, a scan sequence signal UPDN and an output enable signal OEH. According to the scan sequence signal UPDN, the source driver 110 can generate a vertical start pulse signal STVU or STVD, based on which the gate driver 120 controls the scan sequence of the gate lines $GL_1$-$GL_n$. For example, when the scan sequence signal UPDN is logic 0, the source driver 110 outputs the vertical start pulse signal STVU so that the gate driver 120 sequentially outputs the gate driving signals $SG_1$-$SG_n$, thereby scanning the gate lines $GL_1$-$GL_n$ in an up-to-down direction; when the scan sequence signal UPDN is logic 1, the source driver 110 outputs the vertical start pulse signal STVD so that the gate driver 120 sequentially outputs the gate driving signals $SG_n$-$SG_1$, thereby scanning the gate lines $GL_n$-$GL_1$ in a down-to-up direction.

The LCD device 100 depicted in FIG. 1 further includes a pixel matrix 140 having a plurality of pixel units $PX_u$ and $PX_D$. Each pixel unit, including a thin film transistor switch TFT, a liquid crystal capacitor $C_{LC}$ and a storage capacitor $C_{ST}$, is coupled to a corresponding data line, a corresponding gate line and a common voltage $V_{COM}$. In the LCD device 100, the odd-numbered columns of the pixel units $PX_u$ are respectively coupled to the corresponding odd-numbered gate lines $GL_1, GL_3, \ldots, GL_{n-1}$, while the even-numbered columns of the pixel units $PX_D$ are respectively coupled to the corresponding even-numbered gate lines $GL_2, GL_4, \ldots, GL_n$ (assuming n is a positive even number). The LCD device 200 depicted in FIG. 2 further includes a pixel matrix 240 having a plurality of pixel units $PX_u$ and $PX_D$. Each pixel unit, including a thin film transistor switch TFT, a liquid crystal capacitor $C_{LC}$ and a storage capacitor $C_{ST}$, is coupled to a corresponding data line, a corresponding gate line and a common voltage $V_{COM}$. In the LCD device 200, the odd-numbered columns of the pixel units $PX_D$ are respectively coupled to the corresponding even-numbered gate lines $GL_2, GL_4, \ldots, GL_n$, while the even-numbered columns of the pixel units $PX_U$ are respectively coupled to the corresponding odd-numbered gate lines $GL_1, GL_3, \ldots, GL_{n-1}$ (assuming n is a positive even number).

Although the pixel matrices 140 and 240 have different layouts, the LCD devices 100 and 200 both adopt double-gate pixel structure in which two adjacent gate lines control a corresponding row of pixel units and each data line transmits data to two adjacent columns of pixel units. Since the source driver 110 may output odd-numbered or even-numbered data to a data line, two gate lines are used for controlling each row of pixel units, so that the odd-numbered column of pixel units can correctly receive the odd-numbered data and the even-numbered column of pixel units can correctly receive the even-numbered data. The prior art source driver 110 includes a data processor 114, an odd data latch 111, an even data latch 112, and a multiplexer circuit 116. The data processor 114 can receive an original image data DATA. The odd-numbered data and the even-numbered data can then be provided by latching the original image data DATA using the odd data latch 111 and the even data latch 112, respectively. The multiplexer circuit 116 can thus output the odd-numbered data or the even-numbered data according to the output enable signal OEH received from the timing controller 130. Since the double-gate pixel structure may include different pixel layouts, data error may occur in the LCD device 200 if the source driver 110 is designed according to the pixel matrix 140 of the LCD device 100. Likewise, data error may occur in the LCD device 100 if the source driver 110 is designed according to the pixel matrix 240 of the LCD device 200.

FIG. 3 is a timing diagram illustrating the operation of the LCD 200 when the source driver 110 is designed according to the pixel matrix 240 of the LCD device 200. The horizontal start pulse signal STH determines the scan start point of each gate line. The output enable signal OEH switches phase once during the scan period of each gate line. First, illustrations are made to the output sequence of the source driver 110 when the scan sequence signal UPDN is logic 0: when the output enable signal OEH is logic 0, the source driver 110 outputs the even-numbered data $D_2, D_4, \ldots, D_m$; when the output enable signal OEH is logic 1, the source driver 110 outputs the odd-numbered data $D_1, D_3, \ldots, D_{m-1}$. During this period (UPDN=0), the gate driver 120 sequentially scans the gate lines $GL_1$-$GL_n$: the even-numbered pixel unit $PX_u$ controlled by the gate line $GL_1$ is first turned on, thereby correctly receiving the even-numbered data $D_2$ transmitted from the data line $DL_1$; the odd-numbered pixel unit $PX_D$ controlled by the gate line $GL_2$ is then turned on, thereby correctly receiving the odd-numbered data $D_1$ transmitted from the data line $DL_1$; and so on so forth. However, if the timing diagram depicted in FIG. 3 is applied to the LCD device 100, the odd-numbered pixel unit $PX_u$ controlled by the gate line $GL_1$ is first turned on, thereby incorrectly receiving the even-numbered data $D_2$ transmitted from the data line $DL_1$; the even-numbered pixel unit $PX_D$ controlled by the gate line $GL_2$ is then turned on, thereby incorrectly receiving the odd-numbered data $D_1$ transmitted from the data line $DL_1$; and so on so forth.

similarly, illustrations are made to the output sequence of the source driver 110 when the scan sequence signal UPDN is logic 1: when the output enable signal OEH is logic 1, the source driver 110 outputs the odd-numbered data $D_1, D_3, \ldots, D_{m-1}$; when the output enable signal OEH is logic 0, the source driver 110 outputs the even-numbered data $D_2$, $D_4, \ldots, D_m$. During this period (UPDN=1), the gate driver 120 sequentially scans the gate lines $GL_n$-$GL_1$: the odd-numbered pixel unit $PX_D$ controlled by the gate line $GL_n$ is first turned on, thereby correctly receiving the odd-numbered data $D_1$ transmitted from the data line $DL_1$; the even-numbered pixel unit $PX_u$ controlled by the gate line $GL_{n-1}$ is then turned on, thereby correctly receiving the even-numbered data $D_2$ transmitted from the data line $DL_1$; and so on so forth. However, if the timing diagram depicted in FIG. 3 is applied to the LCD device 100, the even-numbered pixel unit $PX_D$ controlled by the gate line $GL_n$ is first turned on, thereby incorrectly receiving the odd-numbered data $D_1$ transmitted from the data line $DL_1$; the odd-numbered pixel unit $PX_u$ controlled by the gate line $GL_{n-1}$ is then turned on, thereby incorrectly receiving the even-numbered data $D_2$ transmitted from the data line $DL_1$; and so on so forth.

In the prior art double-gate LCD devices, an LCD panel having a specific pixel layout can only be correctly driven using a specific source driver. To avoid data error in other applications, either the pixel layout or the design of the source driver needs to be changed, which may increase manufacturing costs.

SUMMARY OF THE INVENTION

The present invention provides a double-gate liquid crystal display device comprising a first gate line configured to transmit a first gate driving signal; a second gate line disposed in parallel with and adjacent to the first gate line and configured to transmit a second gate driving signal; a data line disposed in perpendicular to the first and second gate lines and configured to transmit a first data and a second data; a first pixel unit coupled to the data line and the first gate line and configured to display images according to the first gate driving signal and the first data; a second pixel unit coupled to the data line and the second gate line and configured to display images according to the second gate driving signal and the second data; a gate driver configured to output the first and second gate driving signals according to a vertical start pulse signal; and a source driver configured to generate the vertical start pulse signal according to a scan sequence signal. The source driver comprises a logic circuit configured to generate an odd/even select signal according to the scan sequence signal and an enable signal and a multiplexer circuit configured to receive the first and second data and output one of the first and second data according to the odd/even select signal.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIGS. 6-8 are diagrams illustrating the operations of the LCD device according to the present invention.

DETAILED DESCRIPTION

Figure 1:
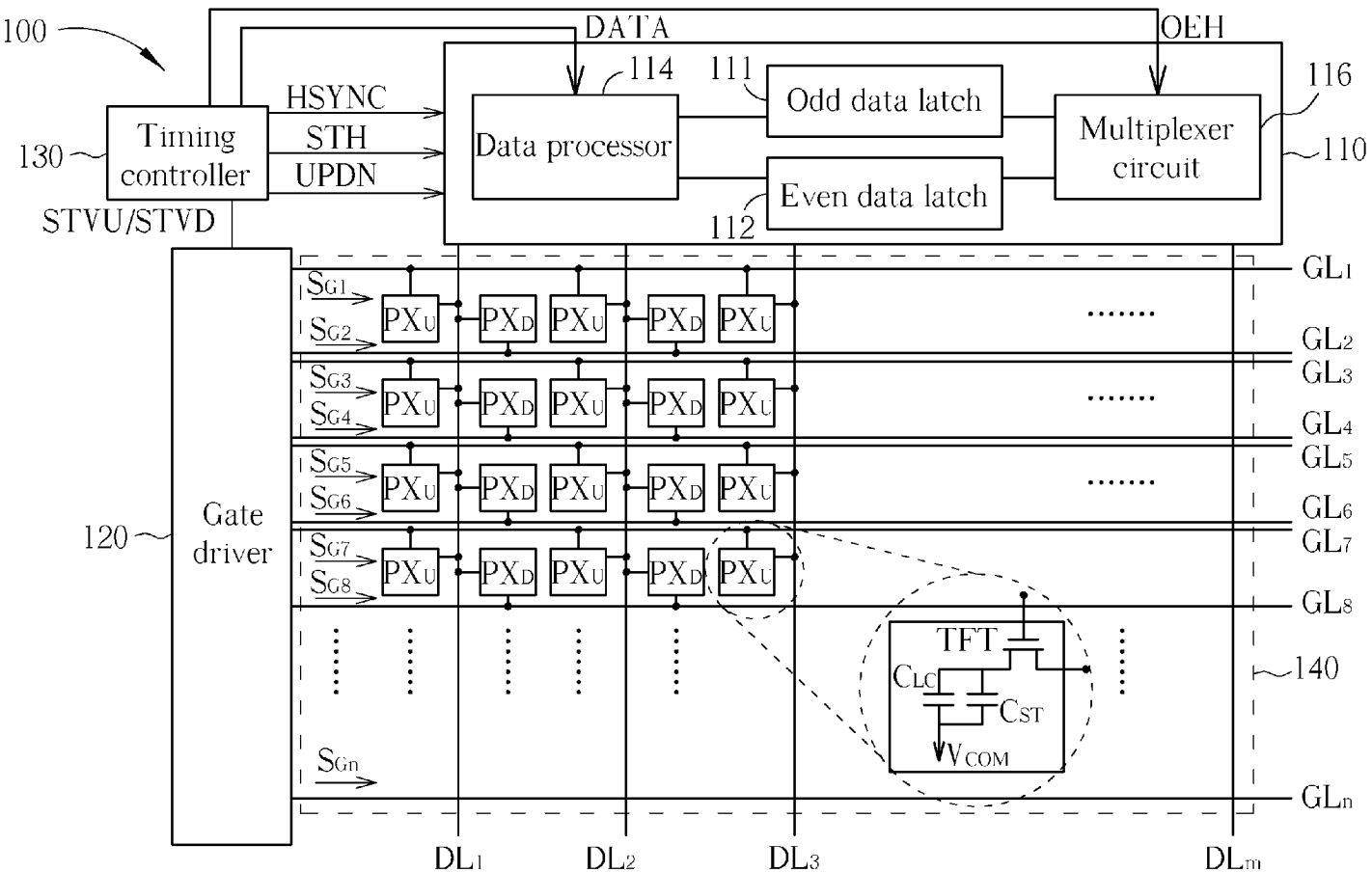
FIG. 1 PRIOR ART
FIGS. 1 and 2 are diagrams illustrating prior art double-gate LCD devices.
Figure 2:
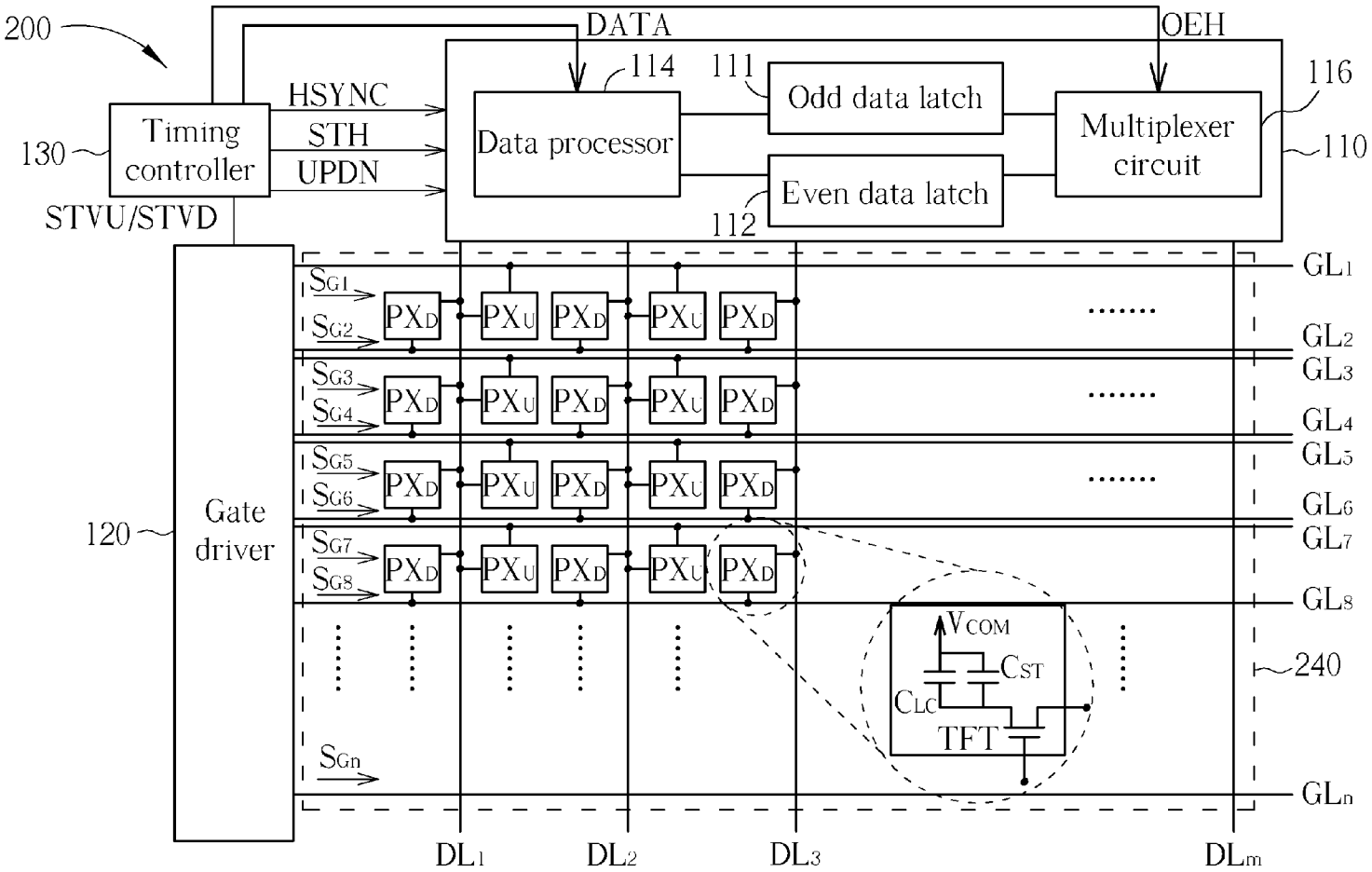
FIG. 2 PRIOR ART
Figure 3:
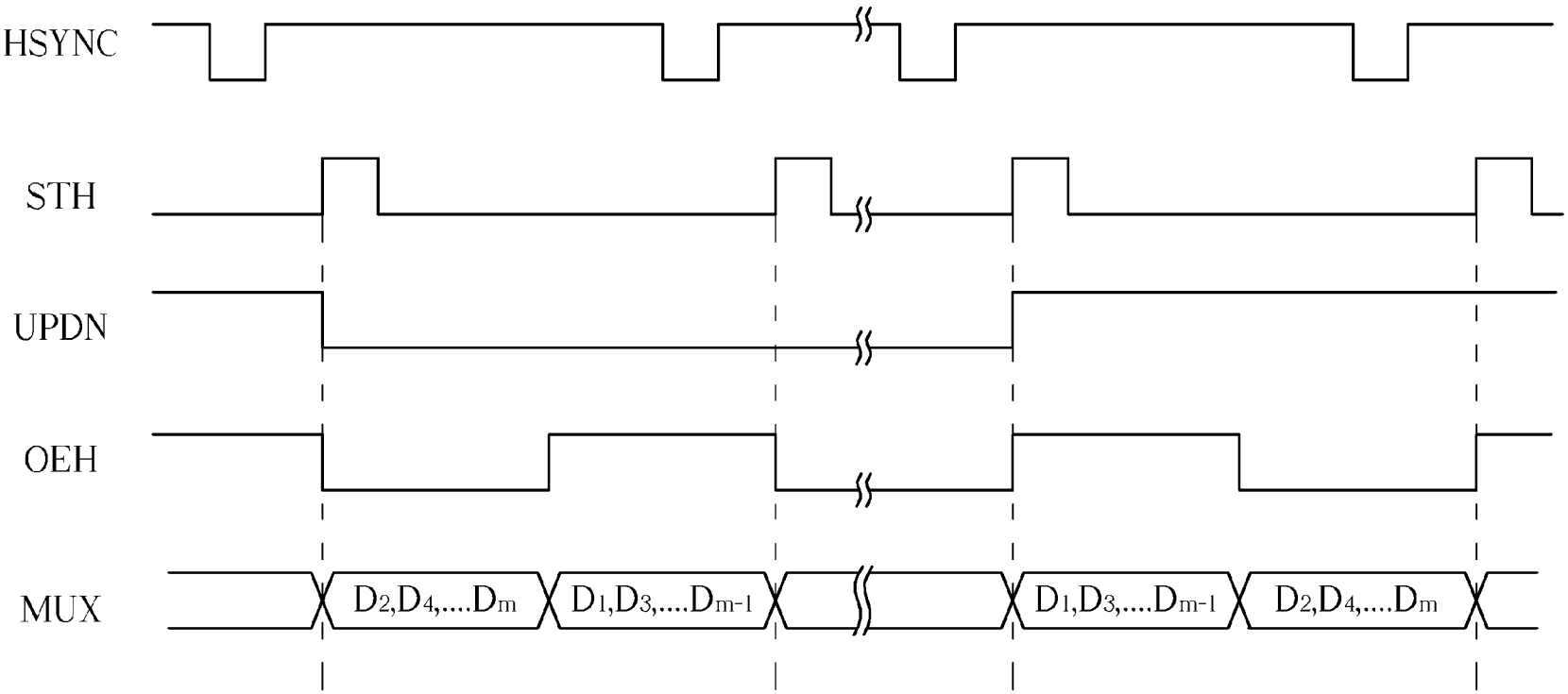
FIG. 3 PRIOR ART
FIG. 3 is a timing diagram illustrating the operation of the double-gate LCD device.
Figure 4:
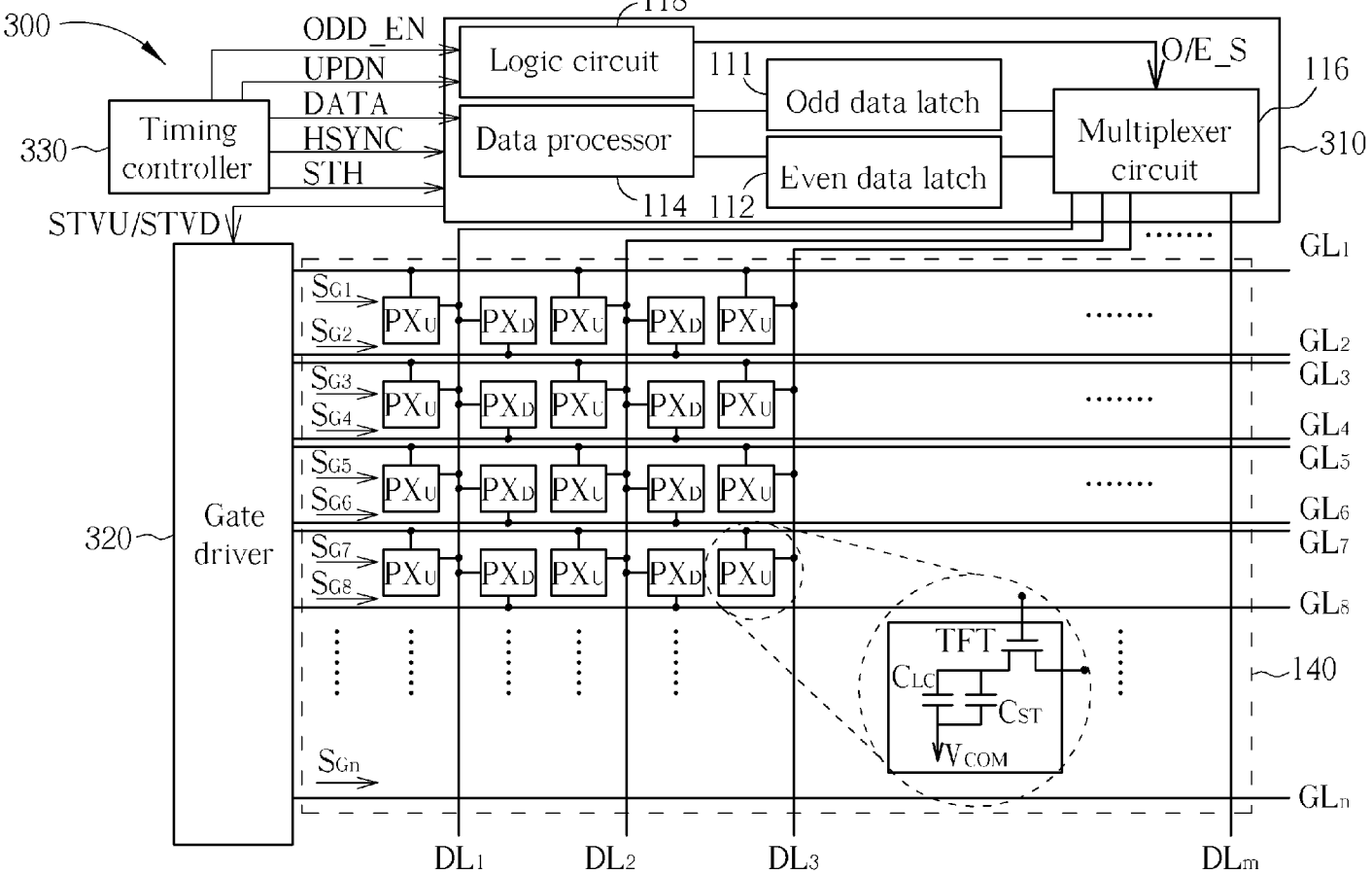
FIGS. 4 and 5 are diagrams illustrating double-gate LCD devices according to embodiments of the present invention.
Figure 5:
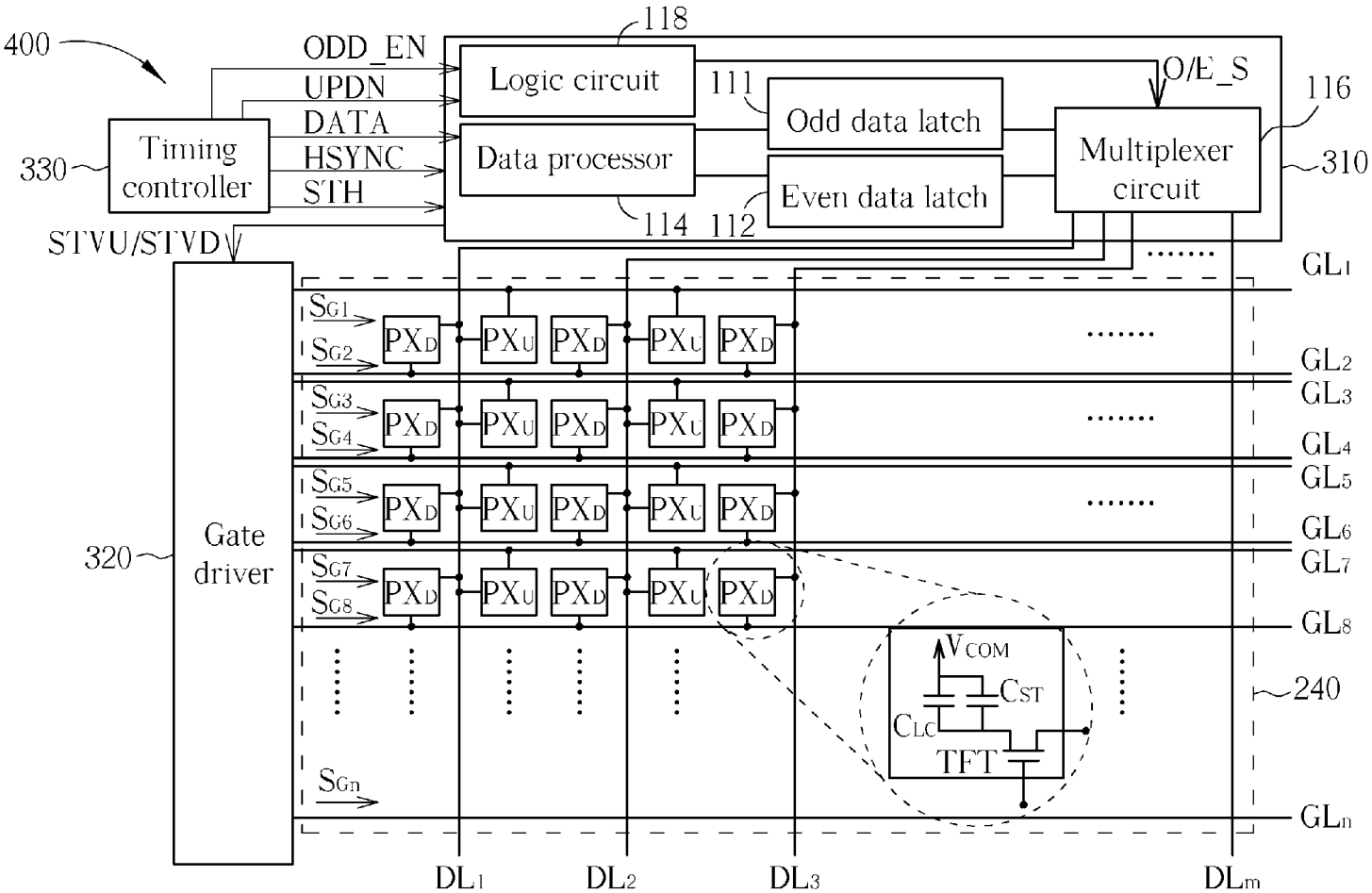

FIG. 4 is a diagram illustrating a double-gate LCD device 300 according to a first embodiment of the present invention. FIG. 5 is a diagram illustrating a double-gate LCD device 400 according to a second embodiment of the present invention. The LCD devices 300 and 400 both include a timing controller 330, a source driver 310, a gate driver 320, a plurality of data lines $DL_1$-$DL_m$, and a plurality of gate lines $GL_1$-$GL_n$. The timing controller 330 can generate control signals for operating the source driver 310, such as a horizontal synchronization signal HSYNC, a horizontal start pulse signal STH, a scan sequence signal UPDN, and an enable signal ODD_EN. According to the scan sequence signal UPDN, the source driver 310 can generate a vertical start pulse signal STVU or STVD, based on which the gate driver 320 controls the scan sequence of the gate lines $GL_1$-$GL_n$. For example, when the scan sequence signal UPDN is logic 0, the source driver 310 outputs the vertical start pulse signal STVU so that the gate driver 320 sequentially outputs the gate driving signals $SG_1$-$SG_n$, thereby scanning the gate lines $GL_1$-$GL_n$ in an up-to-down direction; when the scan sequence signal UPDN is logic 1, the source driver 310 outputs the vertical start pulse signal STVD so that the gate driver 320 sequentially outputs the gate driving signals $SG_n$-$SG_1$, thereby scanning the gate lines $GL_n$-$GL_1$ in a down-to-up direction.

The LCD device 300 depicted in FIG. 4 further includes a pixel matrix 140 having a plurality of pixel units $PX_u$ and $PX_D$. Each pixel unit, including a thin film transistor switch TFT, a liquid crystal capacitor $C_{LC}$ and a storage capacitor $C_{ST}$, is coupled to a corresponding data line, a corresponding gate line and a common voltage $V_{COM}$. In the LCD device 300, the odd-numbered columns of the pixel units $PX_u$ are respectively coupled to the corresponding odd-numbered gate lines $GL_1, GL_3, \ldots, GL_{n-1}$, while the even-numbered columns of the pixel units $PX_D$ are respectively coupled to the corresponding even-numbered gate lines $GL_2, GL_4, \ldots, GL_n$ (assuming n is a positive even number). The LCD device 400 depicted in FIG. 5 further includes a pixel matrix 240 having a plurality of pixel units $PX_u$ and $PX_D$. Each pixel unit, including a thin film transistor switch TFT, a liquid crystal capacitor $C_{LC}$ and a storage capacitor $C_{ST}$, is respectively coupled to a corresponding data line, a corresponding gate line and a common voltage $V_{COM}$. In the LCD device 400, the odd-numbered columns of the pixel units $PX_D$ are coupled to the corresponding even-numbered gate lines $GL_2, GL_4, \ldots, GL_n$, while the even-numbered columns of the pixel units $PX_U$ are coupled to the corresponding odd-numbered gate lines $GL_1, GL_3, \ldots, GL_{n-1}$ (assuming n is a positive even number).

Although the pixel matrices 140 and 240 have different layouts, the LCD devices 300 and 400 both adopt double-gate pixel structure in which two adjacent gate lines control a corresponding row of pixel units and each data line transmits data to two adjacent columns of pixel units. Since the source driver 310 may output odd-numbered or even-numbered data to a data line, two gate lines are used for controlling each row of pixel units, so that the odd-numbered column of pixel units can correctly receive the odd-numbered data and the even-numbered column of pixel units can correctly receive the even-numbered data. The source driver 310 according to the present invention includes a data processor 114, an odd data latch 111, an even data latch 112, a multiplexer circuit 116, and a logic circuit 118. The data processor 114 can receive an original image data DATA. The odd-numbered data and the even-numbered data can then be provided by latching the original image data DATA using the odd data latch 111 and the even data latch 112, respectively. The logic circuit 118 can generate an odd/even select signal O/E_S according to the scan sequence signal UPDN and the enable signal ODD_EN transmitted from the timing controller 330. The multiplexer circuit 116 can thus output the odd-numbered data or the even-numbered data according to the odd/even select signal O/E_S. In the present invention, the logic circuit 118 can be an exclusive OR gate, or other logic devices having similar function.

Figure 7:
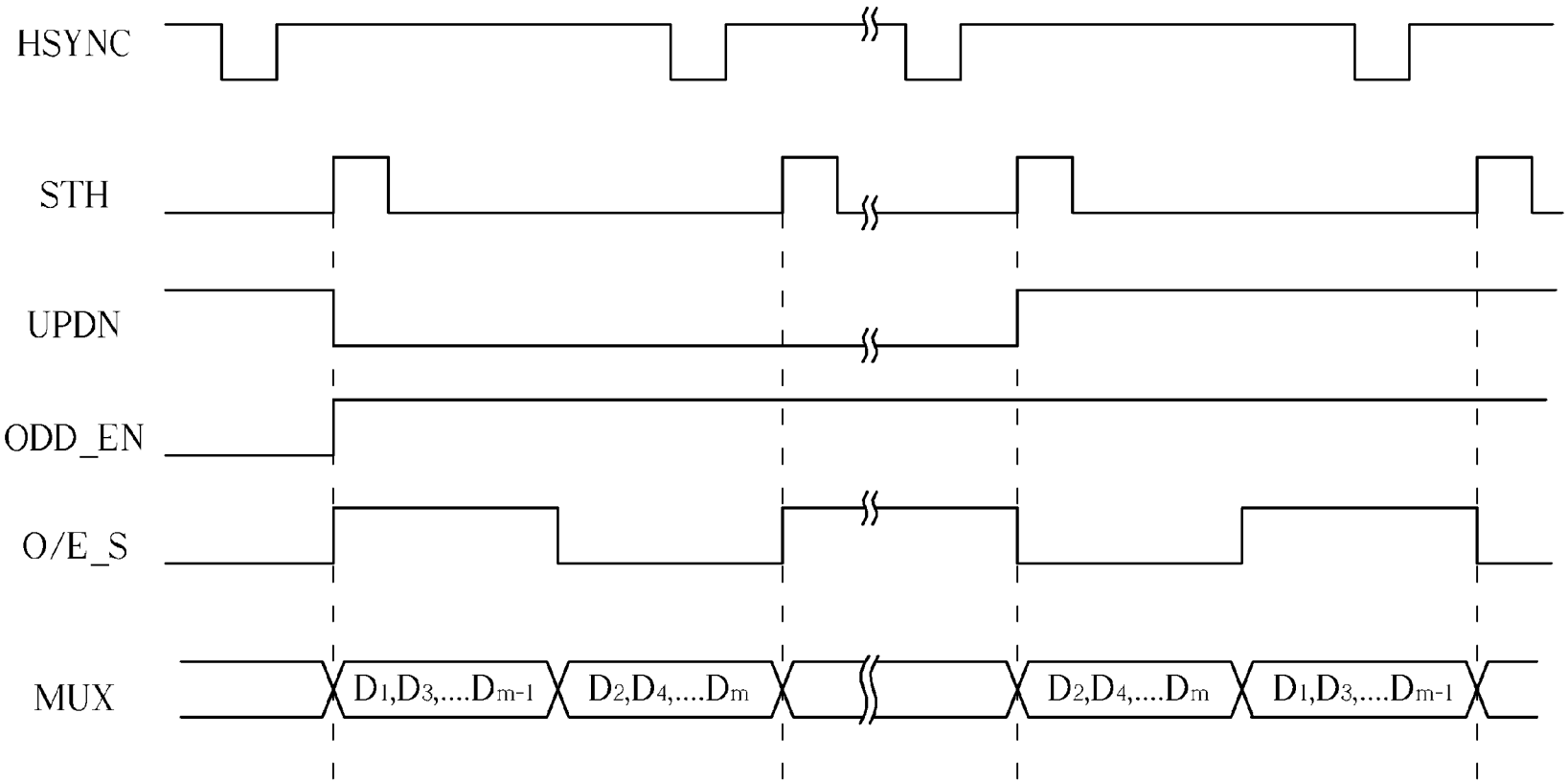
Figure 8:
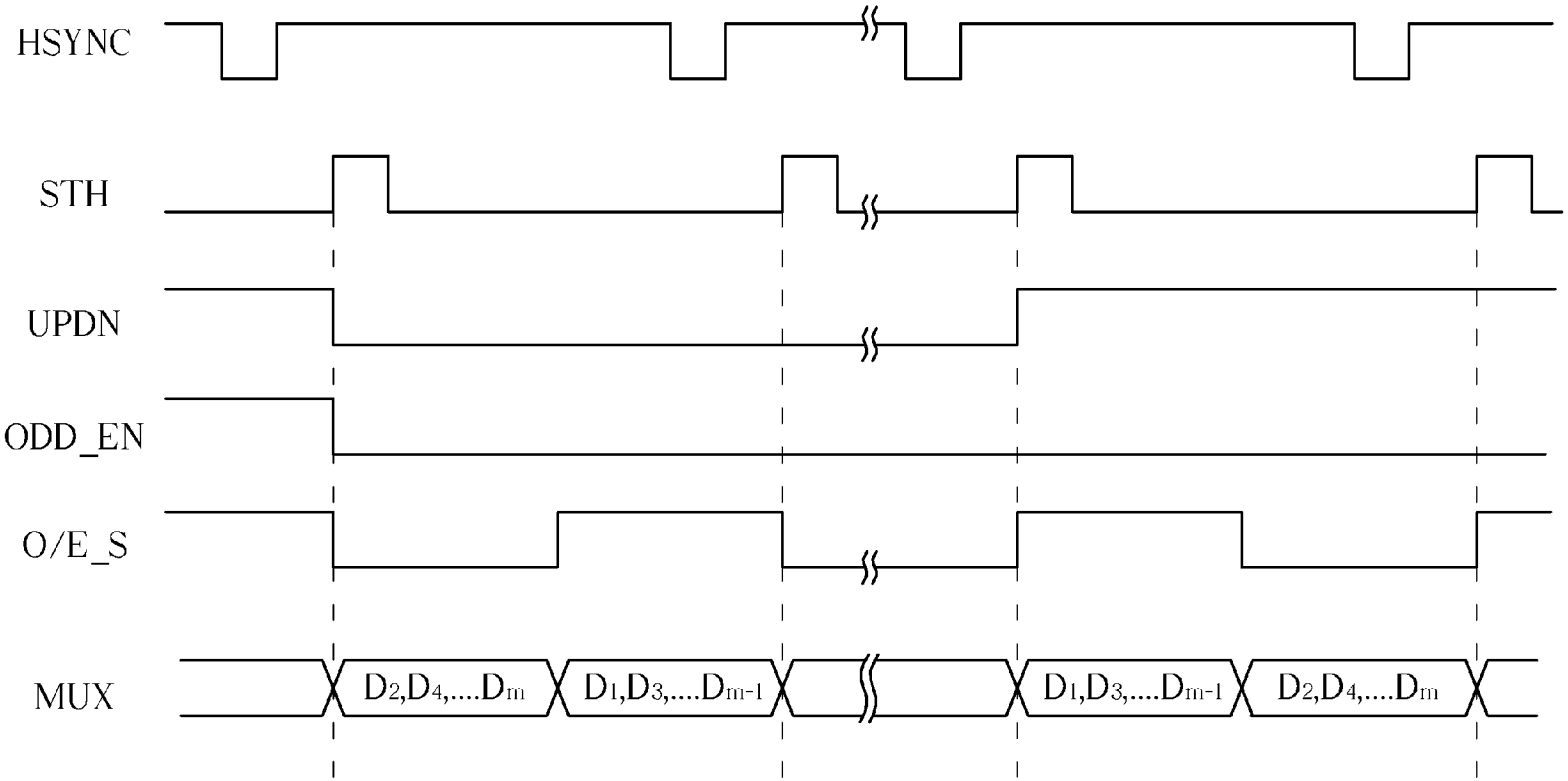

FIGS. 6-8 are diagrams illustrate the operations of the LCD device according to the present invention. FIG. 6 is a truth table of the control signals which shows the logic levels of the scan sequence signal UPSN, the enable signal ODD_EN and the odd/even select signal O/E_S and illustrates how the multiplexer circuit 116 functions according to these signals. FIGS. 7 and 8 are timing diagrams illustrating the operation of the LCD devices according to the present invention.

As depicted in FIG. 6, the source driver 310 of the present invention can be applied to pixel matrices having different layouts by setting the scan sequence signal UPSN and the enable signal ODD_EN properly. For example, when the source driver 310 is applied to the pixel matrix 140 of the LCD device 300, the enable signal ODD_EN can be set to logic 0, and the operation of the LCD devices 300 is illustrated in FIG. 7. First, illustrations are made to the output sequence of the source driver 310 when the scan sequence signal UPDN is logic 0: when the odd/even select signal O/E_S is logic 1, the source driver 310 outputs the odd-numbered data $D_1, D_3, \ldots, D_{m-1}$; when the odd/even select signal O/E_S is logic 0, the source driver 310 outputs even-numbered data $D_2, D_4, \ldots, D_m$. During this period (UPDN=1), the gate driver 320 sequentially scans the gate lines $GL_n$-$GL_1$: the even-numbered pixel units $PX_D$ controlled by the gate line $GL_n$ is first turned on, thereby correctly receiving the even-numbered data $D_2$ transmitted from the data line $DL_1$; the odd-numbered pixel unit $PX_U$ controlled by the gate line $GL_{n-1}$ is then turned on, thereby correctly receiving the odd-numbered data $D_1$ transmitted from the data line $DL_1$; and so on so forth. Similarly, illustrations are made to the output sequence of the source driver 310 when the scan sequence signal UPDN is logic 1: when the odd/even select signal O/E_S is logic 0, the source driver 310 outputs even-numbered data $D_2, D_4, \ldots, D_m$; when the odd/even select signal O/E_S is logic 1, the source driver 310 outputs odd-numbered data $D_1, D_3, \ldots, D_{m-1}$. During this period (UPDN=1), the gate driver 320 sequentially scans the gate lines $GL_n$-$GL_1$: the even-numbered pixel unit $PX_D$ controlled by the gate line $GL_n$ is first turned on, thereby correctly receiving the even-numbered data $D_2$ transmitted from the data line $DL_1$; the odd-numbered pixel unit $PX_U$ controlled by the gate line $GL_{n-1}$ is then turned on, thereby correctly receiving the odd-numbered data $D_1$ transmitted from the data line $DL_1$; and so on so forth.

On the other hand, when the source driver 310 is applied to the pixel matrix 240 of the LCD device 400, the enable signal ODD_EN can be set to logic 1, and the operation of the LCD devices 400 is illustrated in FIG. 8. First, illustrations are made to the output sequence of the source driver 310 when the scan sequence signal UPDN is logic 0: when the odd/even select signal O/E_S is logic 0, the source driver 310 outputs even-numbered data $D_2, D_4, \ldots, D_m$; when the odd/even select signal O/E_S is logic 1, the source driver 310 outputs odd-numbered data $D_1, D_3, \ldots, D_{m-1}$. During this period (UPDN=0), the gate driver 320 sequentially scans the gate lines $GL_1$-$GL_n$: the even-numbered pixel unit $PX_U$ controlled by the gate line $GL_1$ is first turned on, thereby correctly receiving the even-numbered data $D_2$ transmitted from the data line $DL_1$; the odd-numbered pixel unit $PX_D$ controlled by the gate line $GL_2$ is then turned on, thereby correctly receiving the odd-numbered data $D_1$ transmitted from the data line $DL_1$; and so on so forth. Similarly, illustrations are made to the output sequence of the source driver 310 when the scan sequence signal UPDN is logic 1: when the odd/even select signal O/E_S is logic 1, the source driver 310 outputs odd-numbered data $D_1, D_3, \ldots, D_{m-1}$; when the odd/even select signal O/E_S is logic 0, the source driver 310 outputs even-numbered data $D_2, D_4, \ldots, D_m$. During this period (UPDN=1), the gate driver 320 sequentially scans the gate lines $GL_n$-$GL_1$: the odd-numbered pixel unit $PX_D$ controlled by the gate line $GL_n$ is first turned on, thereby correctly receiving the odd-numbered data $D_1$ transmitted from the data line $DL_1$; the even-numbered pixel unit $PX_U$ controlled by the gate line $GL_{n-1}$ is then turned on, thereby correctly receiving the even-numbered data $D_2$ transmitted from the data line $DL_1$; and so on so forth.

In the double-gate LCD devices according to the present invention, the values of the scan sequence signal UPDN and the enable signal ODD_EN can be set according to the layout of the pixel matrices, and a corresponding odd/even select signal O/E_S can thus be generated using the logic circuit 118. Therefore, the present invention can avoid data error in various applications without modifying manufacturing processes or circuit designs.

Those skilled in the art will readily observe that numerous modifications and alterations of the device and method may be made while retaining the teachings of the invention.

What is claimed is:

1. A double-gate liquid crystal display (LCD) device comprising:

a first gate line configured to transmit a first gate driving signal;

a second gate line disposed in parallel with and adjacent to the first gate line and configured to transmit a second gate driving signal;

a data line disposed in perpendicular to the first and second gate lines and configured to transmit a first data and a second data;

a first pixel unit coupled to the data line and the first gate line and configured to display images according to the first gate driving signal and the first data;

a second pixel unit coupled to the data line and the second gate line and configured to display images according to the second gate driving signal and the second data;

a gate driver configured to output the first and second gate driving signals according to a vertical start pulse signal; and a source driver configured to generate the vertical start pulse signal according to a scan sequence signal, the source driver comprising:

a logic circuit configured to generate an odd/even select signal according to the scan sequence signal and an enable signal; and a multiplexer circuit configured to receive the first and second data and output one of the first and second data according to the odd/even select signal.

2. The LCD device of claim 1 further comprising a timing controller configured to provide the scan sequence signal.

3. The LCD device of claim 1, wherein:

the first pixel unit comprises:

a first thin film transistor (TFT) switch including:

a control end coupled to the first gate line;

a first end coupled to the data line; and a second end;

a first liquid crystal capacitor coupled between the second end of the first TFT switch and a common voltage; and a first storage capacitor coupled between the second end of the first TFT switch and the common voltage; and the second pixel unit comprises:

a second TFT switch including:

a control end coupled to the second gate line;

a first end coupled to the data line; and a second end;

a second liquid crystal capacitor coupled between the second end of the second TFT switch and the common voltage; and a second storage capacitor coupled between the second end of the second TFT switch and the common voltage.

4. The LCD device of claim 1, wherein the logic circuit includes an exclusive OR gate.

5. The LCD device of claim 1, wherein the gate driver changes an output sequence of the first and second gate driving signals according to the vertical start pulse signal.

6. The LCD device of claim 1, wherein the source driver further comprises:

a data processor configured to receive an original image data;

a first data latch configured to provide the first data by latching the original image data; and a second data latch configured to provide the second data by latching the original image data.

* * * * *